United States Patent [19]

Simo

[11] Patent Number: 4,898,145

[45] Date of Patent: Feb. 6, 1990

[54] ARROW REST AND HOLDER

[76] Inventor: Miroslav A. Simo, 370 N. Delaplaine, Riverside, Ill. 60546

[21] Appl. No.: 518,957

[22] Filed: Aug. 1, 1983

[51] Int. Cl.[4] ..... F41D 9/00

[52] U.S. Cl. ..... 124/41 A; 124/24 R; 124/88

[58] Field of Search ..... 124/41 A, 24 R, 88

[56] References Cited

U.S. PATENT DOCUMENTS

| | | | |
|---|---|---|---|
| 1,558,703 | 10/1925 | Miller | 272/173 |
| 2,802,461 | 8/1957 | Vance | 124/24 R X |
| 3,769,956 | 11/1973 | Simo | 124/24 R X |
| 3,828,757 | 8/1974 | Finlay | 124/24 R X |
| 3,871,352 | 3/1975 | Stanislawski et al. | 124/41 A |
| 4,054,119 | 10/1977 | Hansen et al. | 124/41 A X |
| 4,074,674 | 2/1978 | Simo | 124/41 A |
| 4,133,334 | 1/1979 | Tone | 124/41 A |
| 4,548,189 | 10/1985 | Pretaszek et al. | 124/41 A |

*Primary Examiner*—Richard J. Apley
*Assistant Examiner*—J. Welsh
*Attorney, Agent, or Firm*—Thomas W. Speckman

[57] ABSTRACT

An arrow rest and holder having a generally flat mounting plate for securement to an archery bow on one side and on the other side having holding means for detachably holding an arrow rest. A retractable arrow rest having an arrow support wire bearing hole angled forwardly and upwardly so that the outwardly extending portion moves forwardly and downwardly to clear an arrow shaft and fletching.

5 Claims, 2 Drawing Sheets

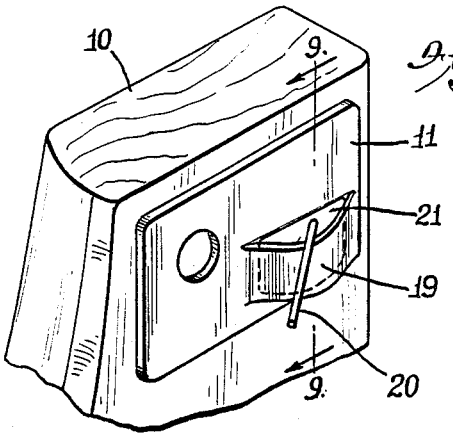
Fig. 7.
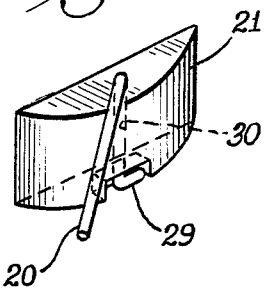
Fig. 8.
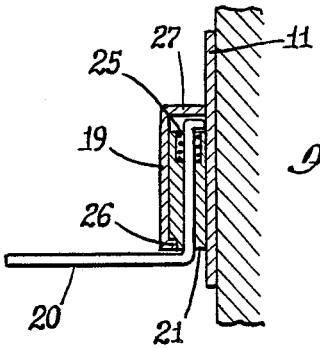
Fig. 10.
Fig. 9.
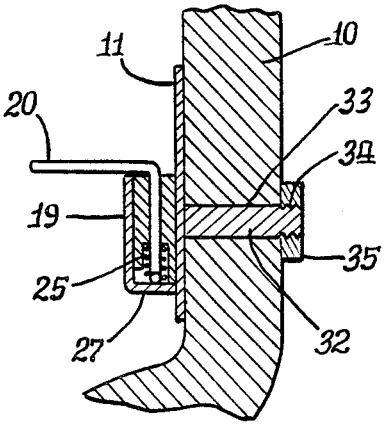
Fig. 11.
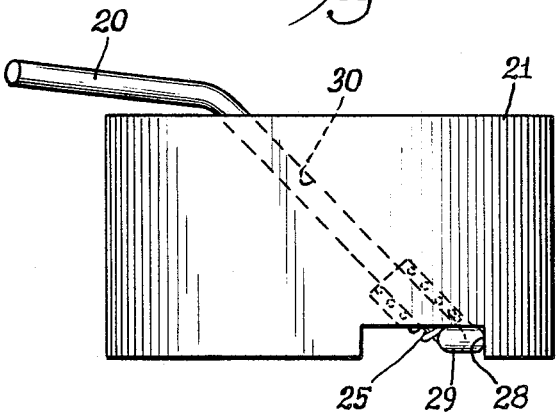
Fig. 12.
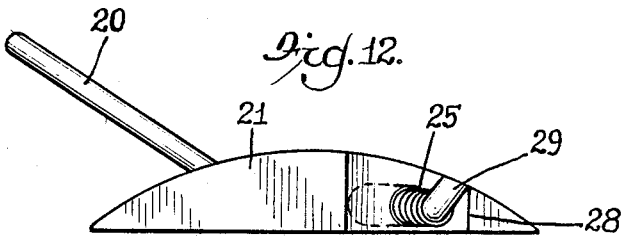

ARROW REST AND HOLDER

BACKGROUND OF THE INVENTION

1. Field of the Invention

This invention relates to an arrow rest and holder for an archery bow, and more particularly to an arrow rest holder permitting removal and replacement of arrow rests in the field with assurance of correct positioning and alignment.

2. Description of the Prior Art

An arrow rest is generally secured to the handle area of an archery bow, and often includes a spring biased arrow rest arm deflecting or retracting as the arrow shaft and fletching pass over the arrow rest arm. Many of the retractable arrow rests have flat back plates which have been secured to the bow handle area with adhesive, screws, or the like, and when replacement is necessary due to breakage or wear, there is no assurance that the new arrow rest, even if of the same style as the old arrow rest, will be properly positioned for shooting without essentially complete realignment.

Exemplary of retractable arrow rests having flat black plates for adhesive attachment to the side of a bow are those taught by U.S. Pat. Nos. 3,769,956, 3,828,757, and 4,074,674. The prior art known to the inventor does not suggest an arrow rest holder whereby an arrow rest, of the type disclosed by the above patents, can be readily replaced in the field with assurance of correct alignment.

SUMMARY OF THE INVENTION

It is an object of this invention to provide an arrow rest holder suitable for holding a wide variety of arrow rests, of the type having relatively flat back plates, in a manner such that the arrow rest may be readily replaced in the field without the use of tools.

Another object of this invention is to provide an arrow rest holder which enables an arrow rest to be removed and remounted in the same position with respect to the bow.

Still another object of this invention is to provide an arrow rest holder which assures correct alignment and positioning of an arrow rest with respect to the bow.

According to the present invention an arrow rest holder has a generally flat mounting plate, the mounting plate having securement means for rigid securement of one side adjacent to a bow and the other side of the mounting plate having holding means for detachably holding an arrow rest. In one embodiment, the mounting plate has pressure sensitive adhesive on the side desired to be adjacent the bow for rigid securement of the mounting plate to the bow, while in another embodiment the mounting plate may be secured to the bow by a wood screw passing through the mounting plate and tightening into the bow or by a machine screw passing through the mounting plate and passing through a hole in the bow with a threaded nut on the opposite side of the bow. Any of a number of presently available arrow rests of the type having a mounting body are suitable for use in conjunction with the arrow rest holder of this invention. The mounting body of the arrow rest is securely held by a holding means on the side of the mounting plate away from the bow in a manner allowing easy removal of the arrow rest in the field without tools and replacement of the arrow rest by a new arrow rest into the arrow rest holder, the positioning of the new arrow rest with respect to the bow being identical or very close to that of the arrow rest removed. A number of suitable holding means for detachably holding the arrow rest in position on the arrow rest holder may be used including a lip along one edge of the flat mounting plate extending therefrom a distance sufficient to firmly engage one edge of the mounting body of the arrow rest; combination of such a lip with undercut edge holding means along adjacent edges of the mounting plate for engagement with opposite sides of the mounting body of the arrow rest; combination of a lip with at least one extension holding structures of the type having a shaft portion and a larger head postion adpated to engage the arrow rest mounting body; undercut opposite edges of the flat mounting plate or three undercut adjacent edges of the mounting plate to engage the corresponding edges of the mounting body of the arrow rest; two extension holding structures extending from the mounting plate, each having a shaft portion and a larger head portion adapted to securely engage the arrow rest mounting body without any of the edge holding structures; and a flexible holding pocket extending from the mounting plate and adapted to snugly hold the arrow rest mounting body.

BRIEF DESCRIPTION OF THE DRAWINGS

The above mentioned and other features and advantages of this invention and the manner of obtaining them will become more apparent, and the invention itself will be best understood by reference to the following description of specific embodiments of the invention taken in conjunction with the accompanying drawings, in which:

FIG. 7 is a perspective view of an arrow rest holder of another embodiment of this invention having a holding pocket for snugly holding an arrow rest mounting body;

FIG. 8 is a perspective view of the arrow rest shown in FIG. 7;

FIG. 9 is a sectional view as indicated by 9—9 in FIG. 7 and additionally illustrates attachment of the arrow rest holder by a threaded stud through the cushion plunger hole;

FIG. 10 is a sectional view of another embodiment of an arrow rest and holder according to this invention;

FIG. 11 is a side view of another embodiment of an arrow rest of this invention; and FIG. 12 is a bottom view of the embodiment shown in FIG. 11.

DESCRIPTION OF PREFERRED EMBODIMENTS

Figure 1:
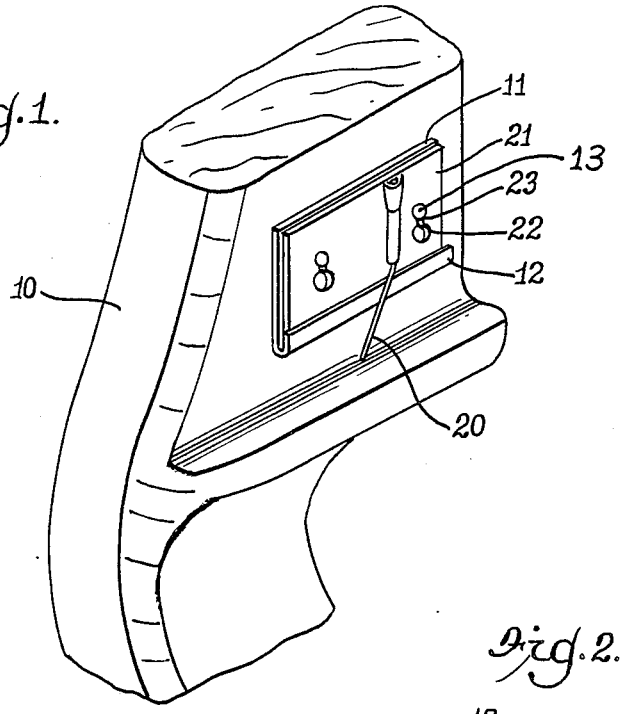
FIG. 1 is a perspective view of an arrow rest holder of one embodiment of this invention attached to the side of a bow with an arrow rest in place.

FIG. 1 shows the bow handle riser portion 10 with generally flat mounting plate 11 of the arrow rest holder firmly secured on one side to the bow. Mounting plate 11 may be secured to the bow by any suitable means. One preferred securement means is coating the one side of mounting plate 11 with any adhesive suitable for firm attached to the bow. Particularly suitable are pressure sensitive adhesives well known in the art. The adhesive may be applied to the one side of the arrow rest holder and covered with a sheet of protective paper (not shown) which may be removed just prior to mounting the arrow rest holder on a bow. There are numerous pressure sensitive materials readily available and use of a woven fabric having a pressure sensitive adhesive on each side is particularly suitable since the fabric may be assembled to the mounting plate of the arrow rest holder during manufacture and further provide additional cushioning and form fitting for attachment to the bow. Any other securement means may be used such as a wood screw passing through a hole in mounting plate 11 or a machine screw passing through a hole in mounting plate 11 and through a hole in the bow with a threaded nut on the opposite side of the bow, as indicated by screw head 16 in FIG. 6. Importance of the securement means is firm retention of the arrow rest holder in constant desired relationship with the bow.

Figure 2:
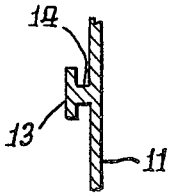
FIG. 2 is a partial sectional view of the back plate of an arrow rest holder of this invention showing one embodiment of an extension holding structure for detachably holding an arrow rest.
Figure 3:
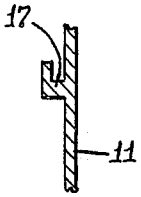
FIG. 3 is a partial sectional view of the back plate of an arrow rest holder showing another embodiment of an extension holding structure for detachably holding an arrow rest.

The other side of mounting plate 11 has holding means for detachably holding arrow rest mounting body 21. In the embodiment shown in FIG. 1 the holding means comprises lip 12 along the bottom edge of mounting plate 11 extending therfrom a distance sufficient to firmly engage the bottom edge of mounting body 21 of the arrow rest. The arrow rest holder mounting plate 11 also has extension holding means with shaft portion 14 and larger head portion 13 extending from mounting plate 11 adapted to securely engage arrow rest mounting body 21 by being inserted through back plate hole 22 and moving undercut shaft 14 along slot 23 thereby securely engaging arrow rest mounting body 21 between the back side of head portion 13 and mounting plate 11. This structure is best seen in the combination of FIGS. 1 and 2. Another extension holding means is shown in FIG. 3 as extension lip 17 which may extend through an oval or rectangular hole in arrow rest mounting body 21 and function in the same manner as just described with respect to the embodiment shown in FIG. 2. It will be apparent to one reading this description that there are a variety of extension holding means of this general nature which may extend from the arrow rest holder through the mounting body of the arrow rest and securely engage the arrow rest mounting body. Such extension holding structures may be used alone or, preferably for more secure positioning, with lip holding means 12 as described with respect to FIG. 1.

Figure 4:
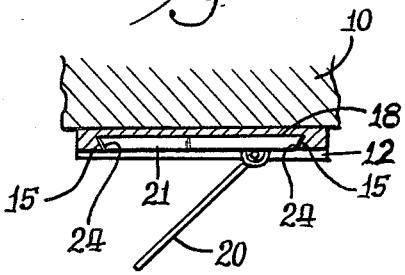
FIG. 4 is a sectional top view of another embodiment of an arrow rest holder according to this invention.
Figure 5:
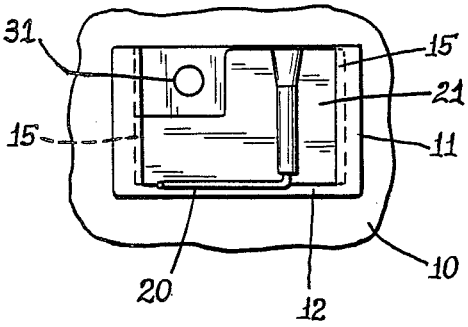
FIG. 5 is a side view of the arrow rest holder shown in FIG. 4.
Figure 6:
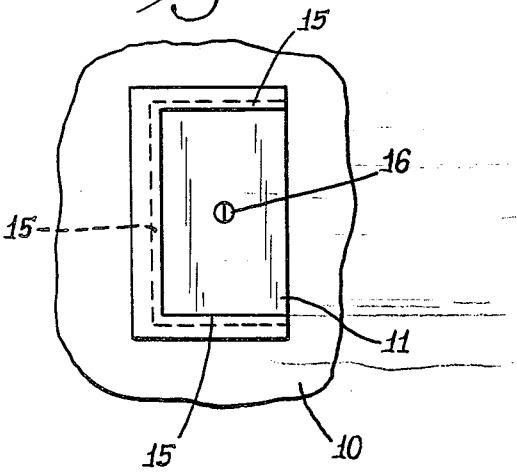
FIG. 6 is a side view of another embodiment of an arrow rest holder according to this invention.

Another means for detachably holding an arrow rest in firm relationship with the arrow rest holder is shown in FIGS. 4, 5 and 6 wherein undercut edge holding means along two opposite edges of recess 18 in mounting plate 11 mate with side edges of arrow rest mounting body 21 to hold the arrow rest in firm position. FIG. 4 shows recess 18 in mounting plate 11 having undercut edges 15 on opposite sides adapted to engage edges 24 of arrow rest mounting body 21. It is seen in FIG. 5 that recess 18 is open along the top side of mounting plate 11 for insertion of arrow rest mounting body 21 and has plunger hole 31. In the embodiment shown in FIG. 6 the arrow rest holder is mounted so that the arrow rest is removed from the back of the bow instead of from the top as shown in FIGS. 1 and 5. In the embodiment shown in FIG. 6 undercut edges 15 of recess 18 extend around three adjacent edges of the recess, the fourth edge being opened for receipt of arrow rest mounting body 21.

Still another means for detachably holding an arrow rest in firm relationship with the arrow rest holder is shown in FIGS. 7, 9 and 10. As shown in FIG. 7, mounting plate 11 has resilient holding pocket 19 extending outwardly and sized to snugly accept and hold arrow rest mounting body 21. FIG. 9 shows that holding pocket 19 may have a solid bottom 27 providing closed, dirt-proof protection of exposed arrow rest return spring 25. To effect return of arrow rest 20, return spring 25 acts at one end against mounting body 21 and at the other end against arrow support wire 20. FIG. 9 also shows another type of securement means for securing mounting plate 11 to bow handle 10 by threaded stud 32 extending thorugh cushion plunger hole 33 with threads 34 extending beyond the other side of bow handle 10 to receive threaded nut 35. FIG. 10 illustrates that holding pocket 19 may be open at the bottom for insertion of arrow rest mounting body 21 from the bottom and is retained snugly in position by locking lip 26. Holding pocket 19 is preferably a resilient, pliable synthetic polymeric material which may be molded in one piece with mounting plate 11 or may be made separately and attached to mounting plate 11. It is apparent from the above description that the shape of a suitable holding pocket may be varied considerably to accommodate a wide variety of arrow rest mounting bodies.

FIG. 8 shows arrow rest mounting body 21 with retractable arrow support wire 20 suitably shaped for holding pocket 19 as shown in FIG. 7. As shown in FIG. 8, arrow rest mounting body 21 has substantially vertical bearing hole 30 with an enlarged cavity at the bottom for retention of spring 25. As shown in FIG. 8, the arrow support wire, after passing through bearing hole 30 has stop protion 29 suitably bent to act as a stop to the outward movement of arrow support wire 20 urged by spring 25. Arrow rest mounting body 21 may be relatively small and prferably fabricated from a metallic material providing wear resistance with positive and uniform stop action. Thus, it is seen that the arrow rest mounting body may be readily removed from the arrow rest holder and easily replaced with a new mounting body having all new working parts or different shaped arrow shaft support wires as desired.

Another embodiment of a suitable arrow rest is shown in FIGS. 11 and 12 whrein bearing hole 30 in arrow rest mounting body 21 is angled forwardly and upwardly, with respect to the position of the arrow rest in position on the bow, so that as arrow support wire moves forwardly it also moves downwardly to better clear the arrow shaft and fletching. Bearing hole 30 may be at any suitable angle to achieve this purpose, angles of about 30° to about 60° to the vertical being preferred. Also, as shown in FIGS. 11 and 12, arrow rest stop portion 29 may be bent to the desired position to function as a positive stop against shoulder 28 to outward urging of arrow support wire 20 by spring 25.

Upon reading this disclosure, it is seen that several modifications are possible without varying the basic principles of the invention. For example, mounting plate 11 may have projections from its back side to more firmly secure it to the bow and to assure proper location of replacement if the arrow rest holder is removed from the bow. Likewise, the surface of mounting plate 11 away from the bow may have desired "dimples" or other means for locking the arrow rest firmly in position in the holder. The general shape of the arrow rest holder may be modified to accommodate various shapes of arrow rest back plates without departing from the invention. A principal feature of the invention is the provision of an arrow rest holder secured to the side of a bow in the desired position while providing secure holding of a detachable arrow rest which may be readily removed and replaced with a different arrow rest in the field while assuring identical or nearly the same positioning of the two arrow rests.

The components of the arrow rest holder of this invention may be constructed from suitable materials providing durability and weather resistance. Suitable metals and moldable plastics will be readily apparent.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An arrow rest holder comprising; a generally flat mounting plate, said mounting plate having securement means for rigid securement of one side adjacent to a bow and the other side of said mounting plate having a holding and positioning means detachably holding and positioning an arrow rest, said holding and positioning means comprising at least one extension holding means comprising a shaft portion and a larger head portion extending from said other side of said mounting plate adapted to securely engage an arrow rest mounting body.

2. An arrow rest holder comprising; a generally flat mounting plate, said mounting plate having securement means for rigid securement of one side adjacent to a bow and the other side of said mounting plate having a holding and positioning means detachably holding and positioning an arrow rest, said holding and positioning means comprising two extension holding means each comprising a shaft portion and a larger head portion extending from said other side of said mounting plate adapted to securely engage an arrow rest mounting body.

3. In combination, an arrow rest holder comprising; a generally flat mounting plate, said mounting plate having securement means for rigid securement of one side adjacent to a bow and the other side of said mounting plate having holding and positioning means detachably holding and positioning an arrow rest, and an arrow rest having a mounting body suitably shaped for engagement with said arrow rest holding and positioning means, said arrow rest mounting body having at least one opening for receiving said arrow rest holding means and said arrow rest holding means comprising at least one extension holding means extending from said other side of said mounting plate adapted to extend through said opening and securely engage said arrow rest mounting body, said holding means comprising a shaft portion and a larger head portion.

4. An arrow rest holder comprising; a generally flat mounting plate, said mounting plate having securement means for rigid securement of one side adjacent to a bow and the other side of said mounting plate having a holding and positioning means detachably holding and positioning an arrow rest, said holding and positioning means comprising a lip along one edge of said flat mounting plate extending therefrom a distance sufficient to firmly hold and position one edge of a mounting body of said arrow rest when in place and at least one extension holding means comprising a shaft portion and a larger head portion extending from said other side of said mounting plate adapted to securely engage said arrow rest mounting body.

5. An arrow rest holder comprising; a generally flat mounting plate, said mounting plate having securement means for rigid securement of one side adjacent to a bow and the other side of said mounting plate having a holding and positioning means detachably holding and positioning an arrow rest, said holding and positioning means comprising a lip along one edge of said flat mounting plate extending therefrom a distance sufficient to firmly hold and position one edge of a mounting body of said arrow rest when in place and two extension holding means, each comprising a shaft portion and a larger head position extending from said other side of said mounting plate adapted to securely engage said arrow rest mounting body.

* * * * *